US009643336B1

(12) United States Patent
Krivohlavek

(10) Patent No.: US 9,643,336 B1
(45) Date of Patent: May 9, 2017

(54) VERTICALLY MOVING HORIZONTAL MIXER ASSEMBLY WITH HIGH EFFICIENCY BLADE AND STATOR DESIGN

(71) Applicant: Asphalt Products, LLC, Catoosa, OK (US)

(72) Inventor: Dennis Krivohlavek, Catoosa, OK (US)

(73) Assignee: Dennis D. Krivohlavek and Lucindy June Krivohlavek, Catoosa, OK (US), Revocable Family Trust ( * ) Notice: Subject to any disclaimer, the term of this patent is extended or adjusted under 35 U.S.C. 154(b) by 111 days.

(21) Appl. No.: 14/534,730

(22) Filed: Nov. 6, 2014

(51) Int. Cl.
*B28C 5/08* (2006.01)

(52) U.S. Cl.
CPC ..... *B28C 5/0806* (2013.01)

(58) Field of Classification Search
CPC ..... B01F 11/0054; B01F 7/00458; B01F 7/00466; B28C 5/0806
USPC ..... 366/286, 289, 316–317; 416/228; 241/278.1, 296–298
See application file for complete search history.

(56) References Cited

U.S. PATENT DOCUMENTS 48,485 A * 6/1865 Griffiths ..... B01F 11/0054 366/289
238,599 A * 3/1881 Lusk ..... F04B 9/02 366/286
245,148 A * 8/1881 Flood ..... A47G 7/025 185/40 F
254,157 A 2/1882 Roat
258,265 A 5/1882 Tonkin
333,388 A * 12/1885 Camp ..... F16H 37/122 74/82
585,837 A * 7/1897 Bliss ..... A47J 43/1075 416/65
646,430 A * 4/1900 Hargrove ..... B01F 11/0054 185/4
661,852 A * 11/1900 Cummings ..... B01F 7/161 366/286
780,926 A * 1/1905 Welds ..... B01F 7/161 366/286
1,304,349 A 5/1919 Moore et al.
1,394,315 A * 10/1921 Lewis ..... B01F 7/161 192/17 R
1,516,792 A 11/1924 Ruggles
1,582,518 A * 4/1926 Horrell ..... B01F 7/00475 366/317
1,890,972 A * 12/1932 Davis ..... B60D 1/66 254/419
1,943,194 A * 1/1934 Vachoux ..... B67D 3/0003 222/181.3
2,262,412 A * 11/1941 Weinig ..... B01D 21/22 210/528

(Continued)

*Primary Examiner* — Abbas Rashid
(74) *Attorney, Agent, or Firm* — Head, Johnson, Kachigian & Wilkinson, PC

(57) ABSTRACT

A vertically moving horizontal mixer assembly which includes a tank having an axis. A stator and blade support assembly is movable parallel to the tank axis. At least one rotatable blade substantially perpendicular to the tank axis is moveable parallel to the tank axis. The rotating blade may be a flat circular disk with raised tooth edges perpendicular to the disk around the circumference of the blade. An optional stator also directs and encourages movement and mixing of solids with liquids.

7 Claims, 10 Drawing Sheets

(56) References Cited

U.S. PATENT DOCUMENTS 2,268,038 A * 12/1941 Knittel ..... B01F 7/0045 366/192
2,406,546 A * 8/1946 Kinney ..... B65D 88/68 15/104.096
2,424,679 A 7/1947 Cowles
2,692,127 A 10/1954 Conn
2,787,447 A 4/1957 Crawford
2,918,264 A 12/1959 Ackles
2,984,462 A * 5/1961 O'Connor ..... A47J 43/0711 366/316
3,030,083 A 4/1962 Stiffler
3,044,750 A 7/1962 Schmitt, Jr.
3,290,016 A * 12/1966 Lennon ..... B01F 7/00466 366/317
3,376,024 A * 4/1968 Beechler ..... B01F 7/00466 416/183
3,402,897 A 9/1968 Willems
3,462,131 A 8/1969 Hill
3,606,577 A 9/1971 Conn
3,630,636 A * 12/1971 Hill ..... B01F 7/00466 416/181
3,999,889 A 12/1976 Caulk et al.
4,125,065 A 11/1978 Lee
4,464,259 A 8/1984 Cramer et al.
4,671,872 A 6/1987 Cramer et al.
4,813,787 A 3/1989 Conn
4,893,941 A 1/1990 Wayte
4,979,986 A * 12/1990 Hill ..... C22B 1/00 366/317
5,409,313 A 4/1995 Funk
5,448,946 A * 9/1995 Laux ..... B29B 17/0052 100/249
5,501,524 A 3/1996 Zuidema
5,839,826 A 11/1998 Eubanks
5,947,599 A * 9/1999 Funk ..... B01F 7/00466 241/162
6,132,080 A * 10/2000 Gurth ..... B01F 7/1625 366/286
7,249,879 B2 * 7/2007 Nabilsi ..... A47J 43/046 222/235
7,316,502 B2 1/2008 Freeman
7,381,027 B2 * 6/2008 Kaneko ..... F04D 29/282 415/102
7,473,025 B1 * 1/2009 Howk ..... B01F 7/00341 29/889.7
8,026,402 B2 * 9/2011 Hassan ..... C07C 13/18 261/83
2005/0084378 A1 * 4/2005 Braun ..... F04D 29/30 416/228

* cited by examiner

VERTICALLY MOVING HORIZONTAL MIXER ASSEMBLY WITH HIGH EFFICIENCY BLADE AND STATOR DESIGN

BACKGROUND OF THE INVENTION

1. Field of the Invention

The present invention is directed to mixing and dissolving particulate solids into liquids. In particular, the present invention is directed to a vertically moving mixer assembly with high efficiency blade and stator design.

2. Prior Art

There has long been a need to vertically move blades in tanks placed in a horizontal plane, that is to say up and down, for more effective mixing of the tank contents. Prior art designs have attempted to solve this issue with multiple blades per shaft. Other prior art designs have attempted to use multiple mixers placing their mixing blades or props at various angles, in or about the horizontal or vertical plane. While these attempts to thoroughly mix a tank have met with various rates of success, they still lack the ability to move a horizontal blade up and/or down vertically to a variety of positions.

The present invention provides a hub suitably designed for horizontal blade attachment, the blade as either part of a hub or separately attached to the hub, wherein the hub has the ability to move horizontally. This design thereby allows movement of the blade vertically throughout a tank to favorably match the level of the tank contents therein. This vertical movement of a horizontally planed mixing blade, impeller, prop or the like, allows one to always control the degree, or extent thereof, of the vortex of the tank contents. The ability to control the extent or degree of a vortex yields, as non-limiting examples, the ability to control aeration of the tank contents, the power requirements for continually mixing the tank contents, and many other useful and practical applications.

The Norstone Company through their Blade Depot® division offers a commonly used set of definitions for the various types of high speed dispersing, grinding and wetting blades commonly used in industry. The Norstone Company definitions are now included herein by references. The Hockmeyer Company offers equipment for utilizing these various high speed dispersing blades. See, for example the Hockmeyer information on Dispersers and their related disperser blades. The Hockmeyer information on various mixing equipment and their associated high speed (defined as 5,200-feet-per-minute peripheral speed) "saw tooth" blade(s) are now included herein by reference. While these two non-limiting examples of current art high speed disperser blades are extensive in their definitions and detail of use, they and other examples fail to show utility in efficiency of use. A good presentation on disperser blades is given by the Morehouse Cowles Company in their presentation "Modern Dispersion Technology—A primer in Dispersers" which is available through the company and now included herein by reference. An excellent discussion on disperser blade speed is available through The Dispersion Blade Company (aka Disperse Tech Dispersion Blades) document "Home>High Speed Dispersion>Tip Speed" which is now included herein by reference. Notwithstanding the foregoing, the present invention herein teaches unexpected and surprising design improvements resulting in better efficiency, as defined by time to melt or otherwise dissolve solids into liquids.

There are many variations of the rotor-stator type mixer/homogenizers available. Some non-limiting examples of these types of mixer, now included herein by reference are made by Chemicolloid Laboratories, Inc., and known commercially as the Charlotte Colloid Mill or Dalworth Machine Products colloid, emulsion and polymer units which use a grooved rotor and stator or waffle type configurations, respectively. Another non-limiting example of a company offering types of rotor-stator configurations, now also included herein by reference, is the Ika Works, Incorporated Company. Ika Works manufactures rotor-stator type mills or mixers wherein teeth or prongs protrude up or out from a disk, all of which is machined as a single unit that rotates in close proximity to a stator that may or may not be of the same configuration. Ika Works also offers a jet mixer line of products wherein a prop blade is enclosed in a specially designed smooth wall stator that is said to concentrate the flow into a high velocity stream while keeping energy consumption low. While these non-limiting examples of current art utilizing rotors and stator provide useful products to industry, there exists a need to improve efficiencies, as defined by time to melt or otherwise dissolve solids into liquids.

These same aforementioned companies in combination with their respective equipment offerings offer industry guidance in combinations of said equipment to perform certain or specific works to a particular industry. One such example of an industry is the asphalt or bitumen industry for making polymer modified asphalt or bitumen, emulsions and specialty products that find utility in the asphalt or bitumen industry. There still exists, however, a need to process more efficiently by use of lower energy requirements thereby lowering product cost.

MOVING HUB PRIOR ART REFERENCES

Roat (U.S. Pat. No. 254,157) discloses vertical shaft movement with an agitating wheel or screw attached to the shaft. A recess at the bottom of the tank is required. The device is designed to mix sediments from the bottom of a tank. In contrast, a recess at the bottom of the tank is not required in the present invention. The present invention teaches away from shaft movement and toward a hub to which the agitating wheel (mixing blade, impeller, propeller and the like) are attached. The present invention teaches mixing any materials be they sedimentary or rise to the top of the liquid in the tank.

Tonkin (U.S. Pat. No. 258,265) discloses mixing sediments from the bottom of a tank by means of a sleeve with a propeller attached. The sleeve is formed with parallel circumferential groves by which it is converted into a cylindrical rack having teeth with a pitch to mesh into teeth of an elevator pinion. This device is limited in its vertical movement by the length of the sleeve. The design does not teach that the materials may be mixed at the top of the tank. The present invention teaches that materials may be drawn into mixing with the contents of the tank by movement of the hub, with the mixing device attached, that are at the upper portion of the tank.

Lee (U.S. Pat. No. 4,125,065) teaches the use of vertical movement of a mixing device for cooking. While indicating movement in an upward and downward direction of a mixing apparatus, it does not teach an ability to stop such vertical movements and simply mix. The present invention teaches that the vertical movements may be held at any desirable location with ensuing mixing.

Cramer et al. (U.S. Pat. No. 4,464,259) and (U.S. Pat. No. 4,671,872) discloses vertical movement of a mixer having the blade, impeller, propeller or the like, also in the vertical plane. This art teaches away from the present invention wherein the blade, impeller, propeller or the like is in a horizontal plane.

DISPERSION BLADE PRIOR ART REFERENCES

Moore et al. (U.S. Pat. No. 1,304,349) teaches appendages attached to a flat disk. These attachments do not have serrations nor are the appendages necessarily on or at the edge of the disk.

Ruggles (U.S. Pat. No. 1,516,792) teaches that an egg beater having a blade with slots or vanes in a rotating disk will have improved performance mixing action. Ruggles does not teach the utility of teeth on or about the edge of the rotating disk.

Cowles (U.S. Pat. No. 2,424,679) teaches vanes on the edge for outward as well as up and down pumping from the plate but has no teeth about the edge of said plate.

Conn (U.S. Pat. No. 2,692,127) teaches that cups or scoops of various shapes formed in a rotating disk will pump or mix liquids and solids by said action.

Crawford (U.S. Pat. No. 2,787,447) teaches that two rotating disks or plates can perform acceptably for wetting solids into liquids. There is no teaching or discussion of teeth about the circumference of the disks.

Ackles (U.S. Pat. No. 2,918,264) shows folds of flat metal that form a square disk having knife edges to slice or cut while not adding air to the mixing materials. These edges have tips that may be formed so as to push liquids outward from the disk by those teeth on the upper part or inward to the disk by the teeth protruding below the disk. There is no teaching or discussion of serrations on the knife edges. There is no teaching or discussion on openings in the disk.

Stiffler (U.S. Pat. No. 3,030,083) teaches that a plurality of openings, holes, throughout a rotating disk and in the teeth of a disk will provide acceptable mixing. Said teeth form into the disk and are, therefore, not on the edge of said disk. These teeth and the holes lack serrations. It is noted that optimum dispersing action requires a rim speed of about 5,000-feet-per-second.

Schmitt (U.S. Pat. No. 3,044,750) teaches that an impeller having teeth about the circumference of a disk, wherein the individual vane (or tooth) has a hole in it and a notch on the leading edge, will facilitate mixing when the tip speed is at or greater than 5,000-feet-per-second. These vanes (or teeth) do not have a plurality of serrations. The disk does not have openings through said disk.

Willems (U.S. Pat. No. 3,402,897) discloses that a disk formed in a wave pattern, that is to say the disk is not flat, can offer advantages in mixing. This disk with a wave pattern has an outer edge that is saw tooth or pointed in shape. Said teeth may be projected above and below the plane of the disk at various angles in alternate fashion. The disk may have up-struck flaps or openings. Art taught therein provides for a casing (a stator or optionally a stator cage) about said disk or disks wherein said casing may have teeth. The teeth on the blade and the teeth on the casing, as taught therein, are complementary to each other and engage mutually. The stator may be jacketed or as a cage contained in a housing similar to that of a centrifugal pump. The '897 patent does not teach the utility of rotating flat disks having teeth at about 90° perpendicular to the flat disk with serrations in the edges of the teeth. The stator, as taught in '897, does not provide for utility within a tank.

Hill (U.S. Pat. No. 3,462,131) teaches art with three rotating disks. The upper disk has teeth about the circumference of said disk that are perpendicular to and above the disk and pitched in to the center of the disk. This upper disk has openings between the teeth and its center. The center disk is flat with openings between the circumference and its center. The bottom disk has teeth about the circumference of said disk that are perpendicular to and below the disk and pitched in to the center of the disk. This lower disk has openings between the teeth and its center. Movement of material is by force through the openings of the upper and lower disks to the center disk wherein mixing and shear are imparted before materials pass outwardly from the trio of disks. There are no serrations on the teeth and the teeth do not alternate on individual disks.

Conn (U.S. Pat. No. 3,606,577) describes a double-blade system with a top disk having openings whereby materials are pumped downward and a second disk having openings whereby materials are pumped upward. The material mixes between the teeth before passing between said disks past teeth alternating upwardly and downwardly at various angles about but always divergently from about the circumference of each disk. These teeth are not perpendicular to the disk and are not serrated.

Caulk et al. (U.S. Pat. No. 3,999,889) describes a mixing head comprised of upper and lower disks with slots through said disks. These disks are attached one to the other by mixing blades extending from one disk to the other. There is no discussion of serrated teeth or teeth extending above and or below the disks.

Conn (U.S. Pat. No. 4,813,787) teaches an extension of U.S. Pat. No. 3,606,577 wherein the teeth on each disk change in length, or angular extension with respect of one adjacent to the other. There is no discussion of teeth having serrations.

Wayte (U.S. Pat. No. 4,893,941) teaches the utility of two disks attached one to the other by vanes. The upper disk is a washer shaped disk thereby allowing fluid to move to the center about the shaft, down to the lower disk. Fluid is then forced via the vanes along the lower disk and outward from the set of disks. There is no teaching or discussion of serrations on the disks.

Funk (U.S. Pat. No. 5,409,313) teaches a flat disk with teeth that are on the edge corners of the disk. These teeth are removable. The art does not teach utility of any serrations on the teeth.

Zuidema (U.S. Pat. No. 5,501,524) teaches that mixing arms that mix materials to and for many times about and against stators. The materials are mixed initially in one housing then further in a second housing. There is no discussion of serrated teeth on the circumference of a disk.

Eubanks (U.S. Pat. No. 5,839,826) teaches a blender having a top aerating blade and a lower wavy blade mixes materials rather than chops or homogenizes said materials. While the '826 patent teaches blades or disks in a wave, the art does not teach the utility of serrated teeth essentially perpendicular to flat disk.

Freeman (U.S. Pat. No. 7,316,502) teaches that a plastic disk with openings top to bottom through the disk at various angles will facilitate intermingling of materials above and below the glade(s). The teeth are extended outwardly from a circumferential edge (face) of the disk. There may be groves or spaces between the teeth to create an upper and or lower set of teeth. The art of '502 patent does not teach the utility of teeth at about perpendicular to the plane of the disk having serrations.

STATOR PRIOR ART REFERENCES

Willems (U.S. Pat. No. 3,402,897) has art wherein a disk formed in a wave pattern, that is to say the disk is not flat, can offer advantages in mixing. This disk with a wave pattern has an outer edge that is saw tooth or pointed in shape. Said teeth may be projected above and below the plane of the disk at various angles in alternate fashion. The disk may have up-struck flaps or openings. Art taught therein provides for a casing (a stator or optionally a stator cage) about said disk or disks wherein said casing may have teeth. The teeth on the blade and the teeth on the casing, as taught therein, are complementary to each other and engage mutually. The stator may be jacketed or as a cage contained in a housing similar to that of a centrifugal pump. The art of '897 does not teach the utility of rotating flat disks having teeth at about 90° perpendicular to the flat disk with serrations in the edges of the teeth. The stator, as taught in '897, does not provide for utility within a tank.

Zuidema (U.S. Pat. No. 5,501,524) teaches that mixing arms that mix materials to and for many times about and against stators. The materials are mixed initially in one housing then further in a second housing. There is no discussion of serrated teeth on the circumference of a disk.

Notwithstanding the foregoing, there remains a need to more efficiently disperse solids into liquids and to decrease the melt times of solids into liquids.

An unexpected and surprising result of the efficiencies of a combination of using a vertically moving hub with a more efficient mixer blade in combination with an improved stator design is set forth and taught herein.

SUMMARY OF THE INVENTION

The present invention is directed to a vertically moving horizontal mixer assembly which includes a substantially cylindrical tank.

A mixer assembly includes a stator and blade support assembly movable in alternate directions parallel to the axis of the tank. The stator and blade support assembly includes a pair of spaced apart screw thread shafts, each of which is parallel to the tank axis.

The screw thread shafts are fixed at their ends to the stator and blade support assembly. A pair of shaft sprockets has central openings to receive the screw thread shafts therethrough. Rotation of the sprockets causes axially movement of the shafts.

A lift motor has a drive shaft which moves a continuous chain or chains which, in turn, rotates the shaft sprockets. Rotation of the sprockets causes movement of the stator and blade support assembly in a direction parallel to the tank shaft axis.

The stator and blade support assembly includes a first pair of blocks as well as an opposed second pair of blocks which travel within notches or channels of parallel I-beams.

A blade motor having a drive shaft rotates a blade motor shaft. The blade motor shaft extends through the tank and passes through the stator and blade support assembly.

The blade motor shaft rotates at least one rotating blade which is substantially perpendicular to the tank axis.

An optional stator may take a number of configurations, such as substantially cylindrical with an upper conical portion. The stator may be slightly below the level of the rotating blade although alternate arrangements are possible.

The rotating blade includes a flat circular disk with a plurality of raised tooth edges which are perpendicular to the flat disk.

The rotating blade includes a central opening for attachment to the blade motor shaft. The raised tooth edges or teeth may be slightly higher at the trailing edge than at the leading edge. A plurality of optional openings may also be provided between the central opening and the outer circumference of the disk. In addition, a further set of openings may be in the form of louvers or tabs which encourage movement in mixing of materials.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
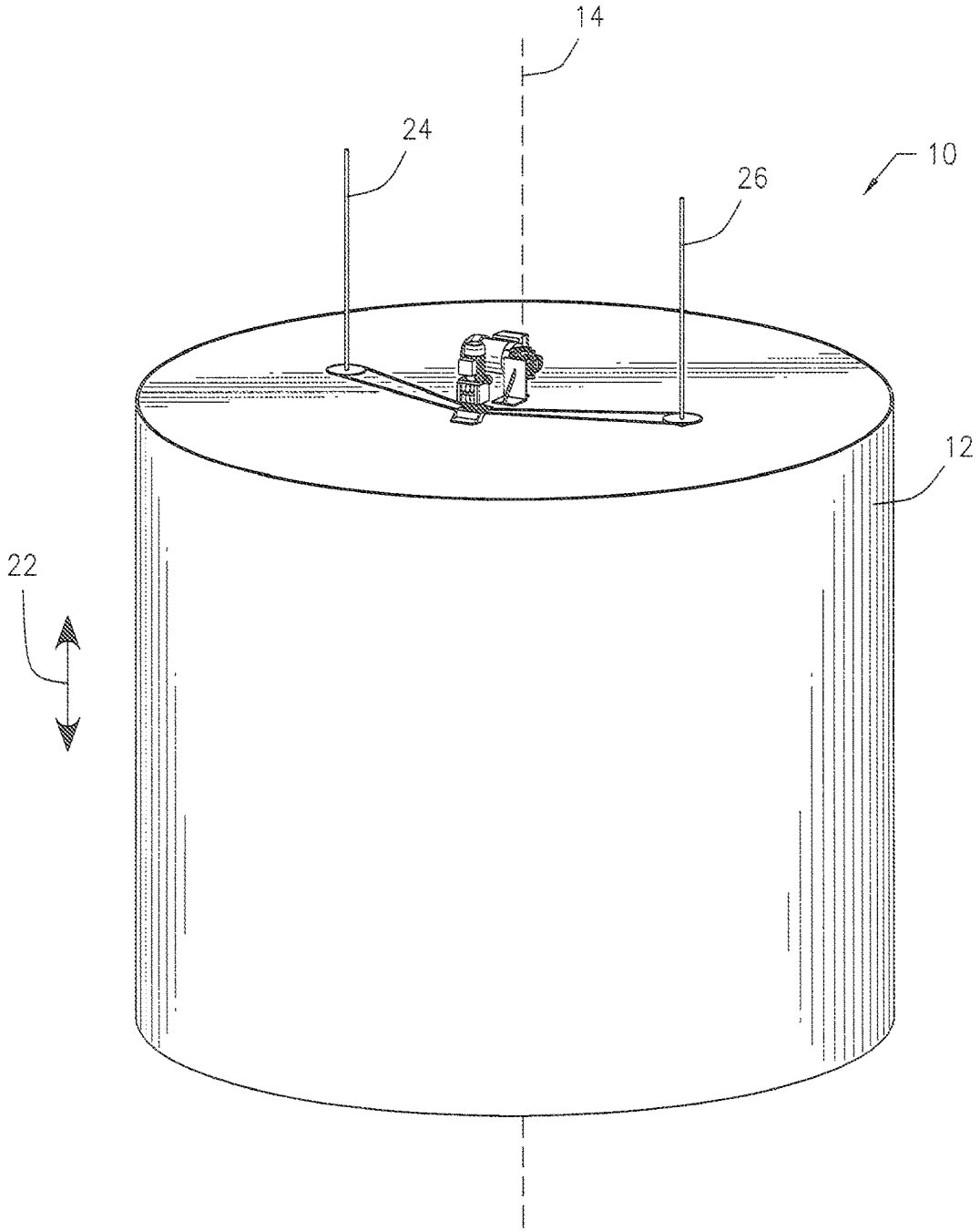
FIG. 1 illustrates a perspective view.
Figure 2:
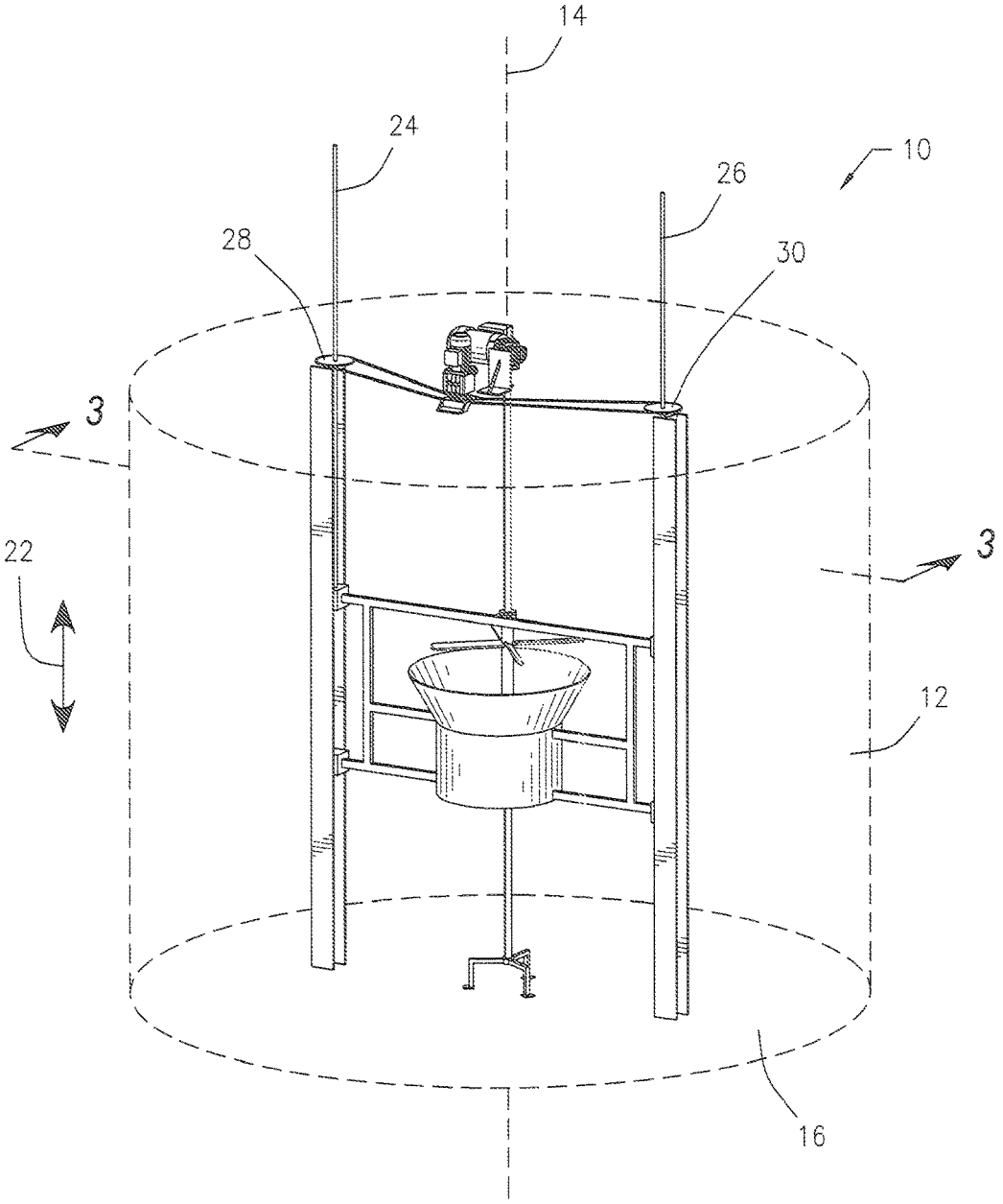
FIG. 2 illustrates a partial cut-away view of a preferred embodiment of a vertically moving horizontal mixer assembly constructed in accordance with the present invention.
Figure 3:
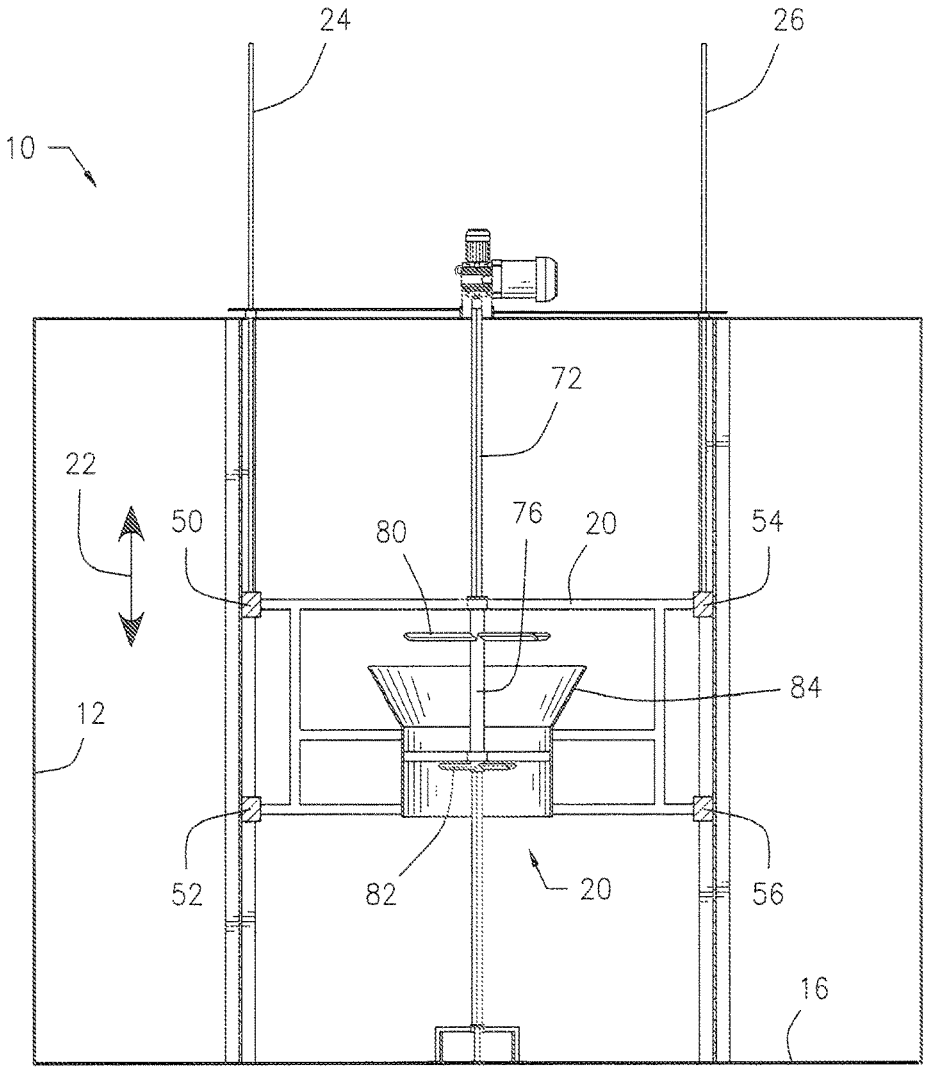
FIG. 3 illustrates a sectional view taken along section line 3-3 of FIG. 2.

Referring to the drawings in detail, FIG. 1 illustrates a perspective view of a vertically moving horizontal mixer assembly 10 constructed in accordance with the present invention. FIG. 2 illustrates a cut away view of the mixer assembly 10 shown in FIG. 1. FIG. 3 illustrates a sectional view taken along section line 3-3 of FIG. 2. The mixer assembly 10 includes a substantially cylindrical tank 12 having a closed base 16 and an optional top. The tank 12 includes an axis 14 (illustrated by dash lines).

The mixer assembly 10 includes a stator and blade support assembly 20. The stator and blade support assembly 20 is movable in alternate directions parallel to axis 14 of the tank as illustrated by arrow 22. As best seen in FIGS. 2 and 3, the stator and blade support assembly 20 includes a pair of spaced apart screw thread shafts 24 and 26. Each of the threaded shafts 24 and 26 is parallel to the tank axis 14. The screw thread shafts 24 and 26 are fixed at their ends to the stator and blade support assembly 20 so that movement of the shafts 24 and 26 results in movement of the stator and blade support assembly 20. A pair of shaft sprockets 28 and 30 has central openings to receive the screw thread shafts 24 and 26 therethrough. Rotation of the sprockets 28 and 30 causes axial movement of the screw thread shafts as shown by arrow 22.

Figure 4:
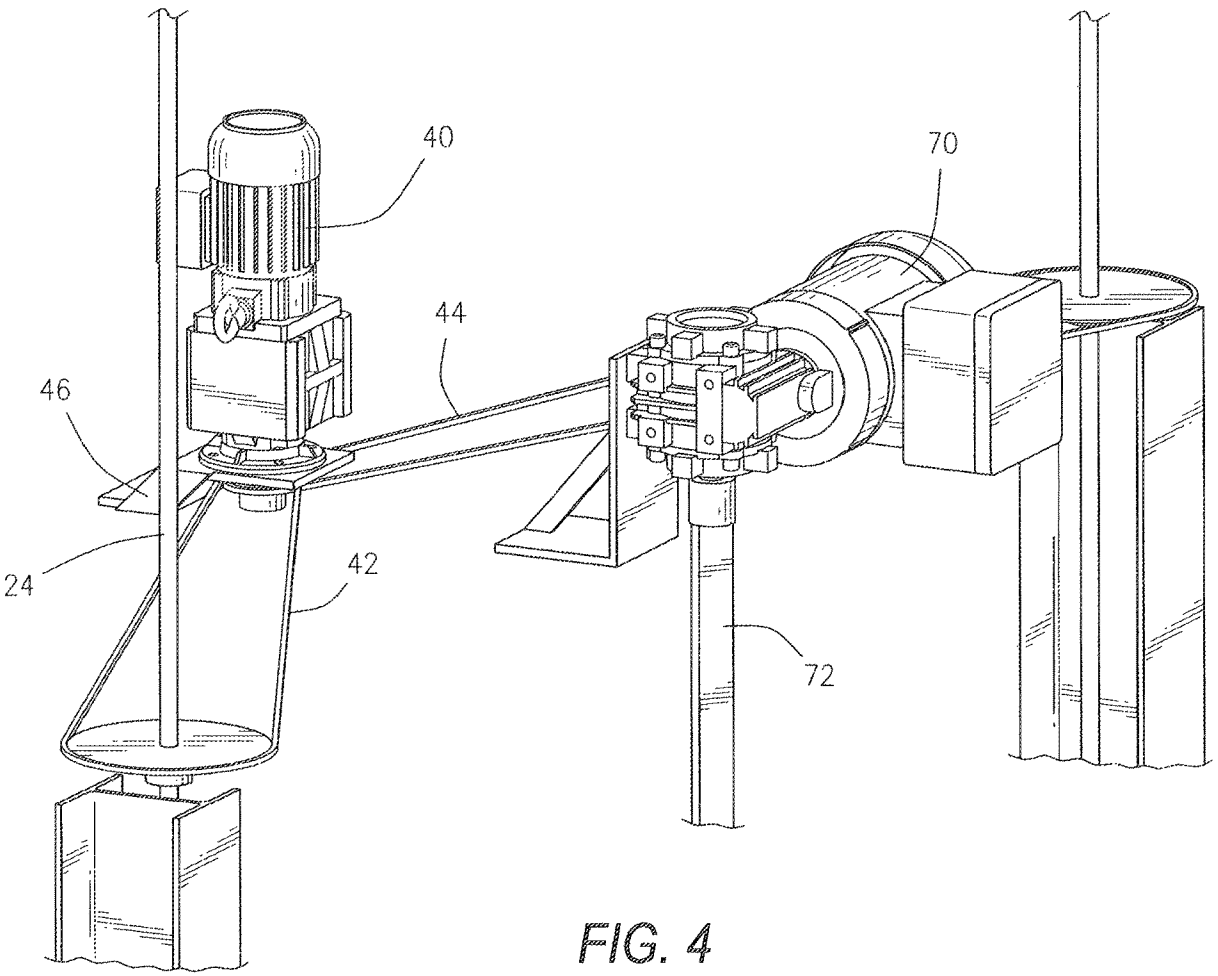
FIG. 4 illustrates a portion of the mixer assembly with the tank removed for clarity.

FIG. 4 illustrates a portion of the mixer assembly 10 with the tank 14 removed for clarity. A lift motor 40 has a drive shaft which moves a continuous chain or chains 42 and 44, which in turn rotates the shaft sprockets 28 and 30. It will be appreciated that a belt or belts might be used within the spirit and scope of the invention. Rotation of the sprockets 28 and 30 causes movement of the stator and blade support assembly 20 in a direction parallel to the shaft of the tank axis 14. The lift motor 40 may be secured to the assembly 10 by a lift bracket 46.

As seen in FIGS. 2 and 3, the stator and blade support assembly 20 includes a first pair of blocks 50 and 52 as well as an opposed second pair of blocks 54 and 56. The blocks 50, 52, 54 and 56 travel within notches or channels of parallel I-beams 58 and 60. The I-beams are likewise parallel to the tank axis.

Returning to a consideration of FIG. 4, a blade motor 70 having a drive shaft rotates a blade motor shaft 72. The blade motor shaft 72 extends through the tank 12 and may be supported by a support 74 near the base of the tank 12 (seen in FIGS. 2 and 3). The blade motor shaft 72 passes through and is supported by the stator and blade support assembly 20.

The blade motor shaft 72 rotates a hub 76 which rotates at least one rotating blade 80, which is substantially perpendicular to the tank axis 14. The rotating blade 80 is shown diagrammatically in FIGS. 2 and 3, and will be described in detail herein. It has been found that a single rotating blade 80 is adequate, however, a secondary blade or blades 82 might be employed.

Figure 5:
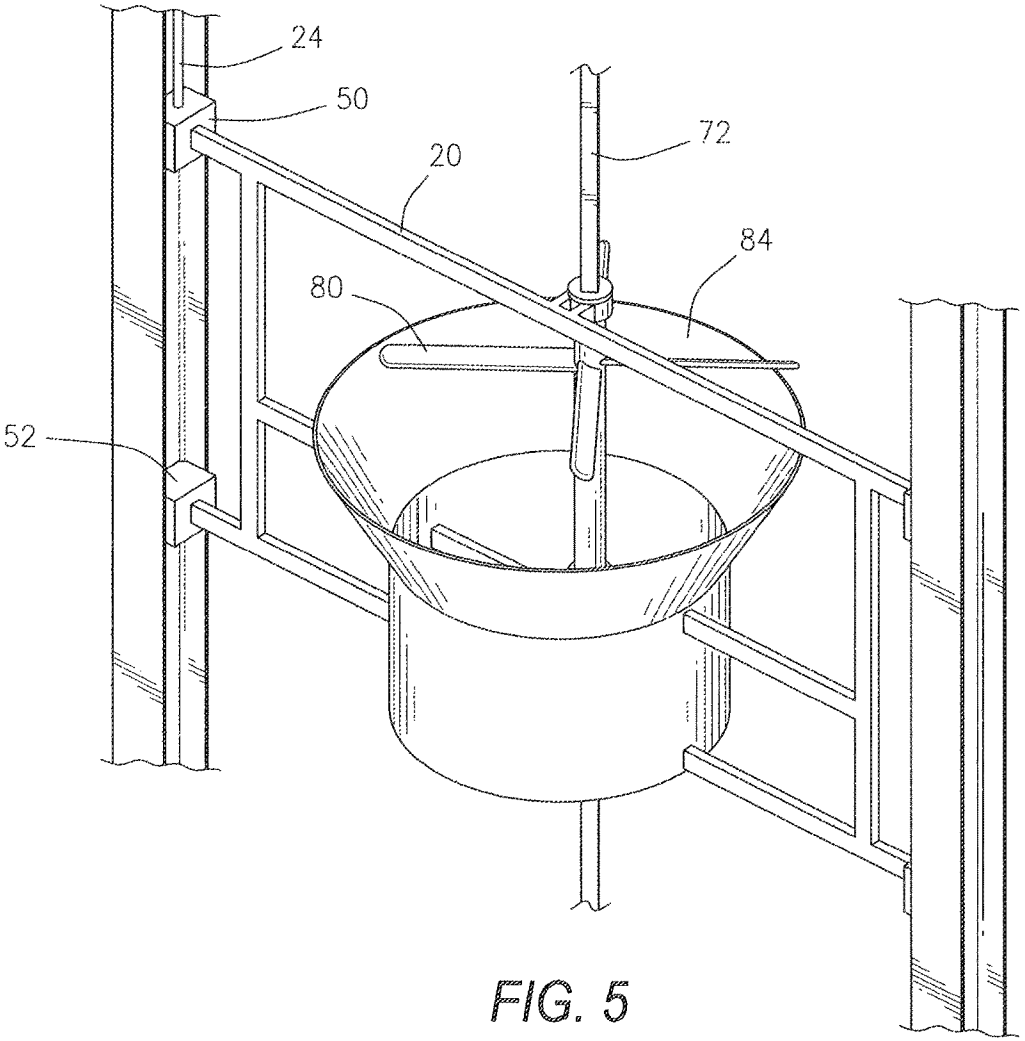
FIG. 5 illustrates a perspective view of a portion of the mixer assembly with the tank removed for clarity.

Returning to a consideration of FIGS. 2 and 3 as well as a perspective view of the stator and blade support assembly 20 shown in FIG. 5, an optional stator 84 may take a number of configurations. In a preferred embodiment shown herein, the stator 84 is substantially cylindrical with an upper conical portion. In the preferred embodiment shown, the stator 84 is slightly below the level of the rotating blade 80 although alternate arrangements are possible within the spirit and scope of the present invention. The stator 84 may have smooth internal walls or alternatively may have protrusions, dimples or other disruptive surfaces such as openings or holes which encourage mixing.

Figure 6:
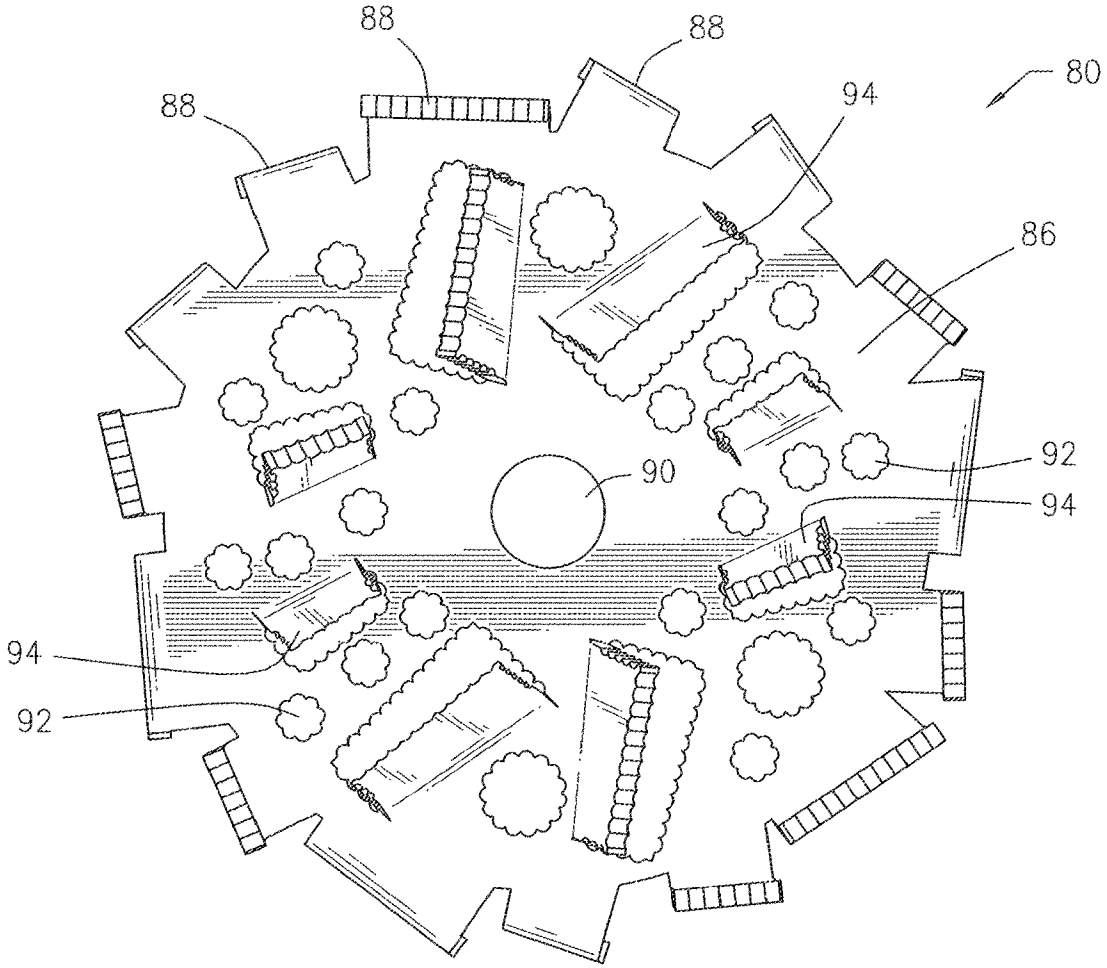
FIG. 6 shows a front view.
Figure 7:
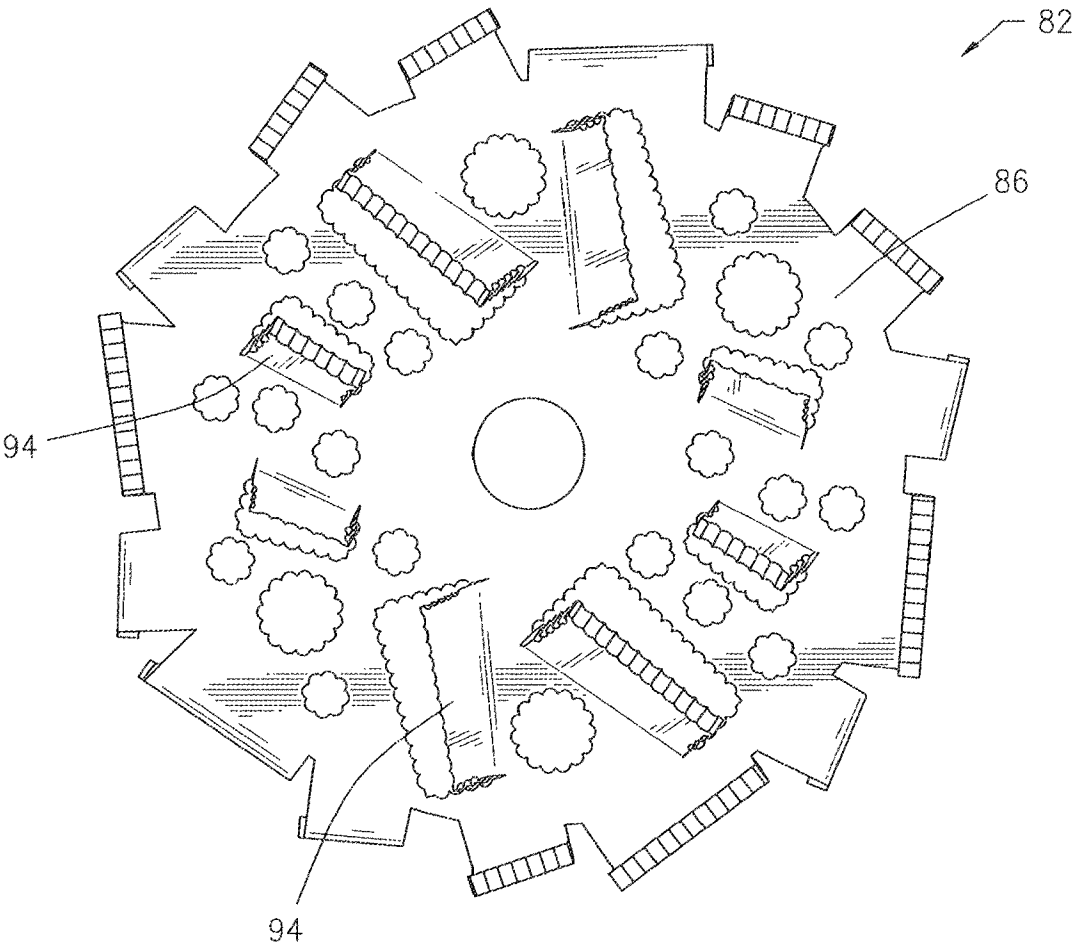
FIG. 7 shows a rear view.
Figure 8:
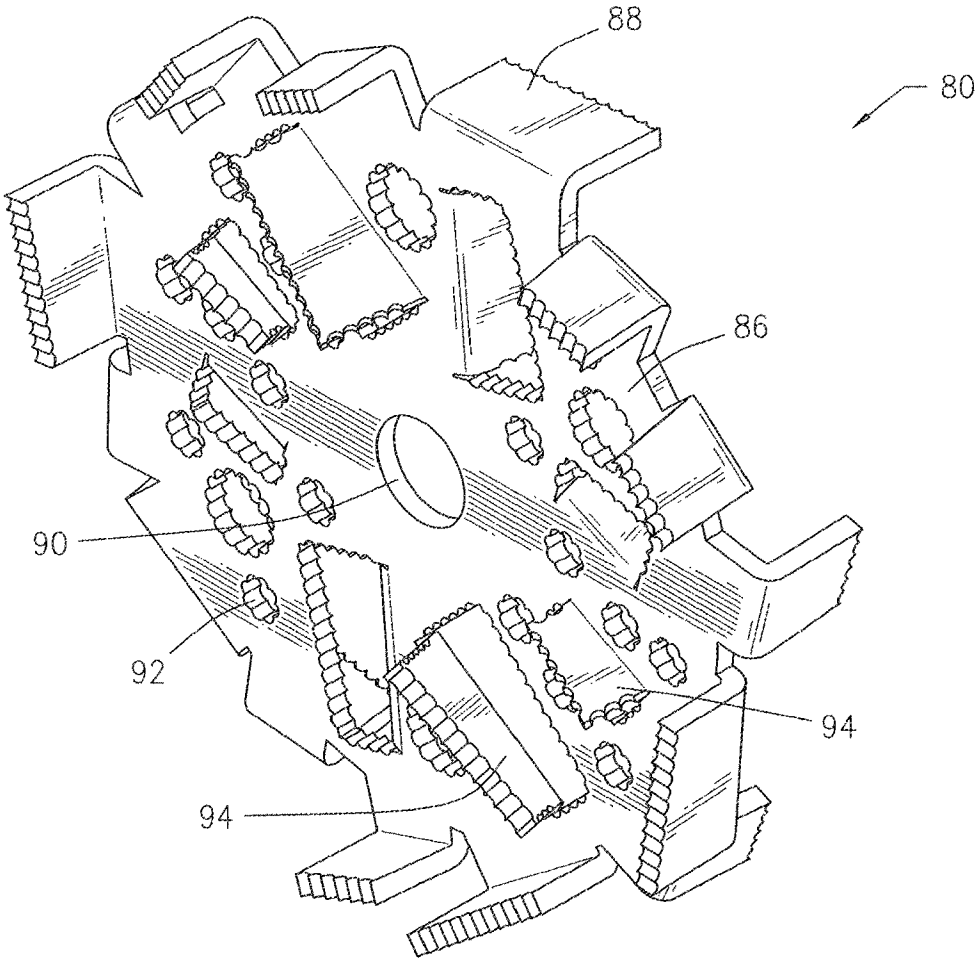
FIG. 8 shows a perspective view of one configuration of a rotating blade of the present invention.

FIG. 6 shows a front view, FIG. 7 shows a rear view and FIG. 8 shows a perspective view of one configuration of a rotating blade 80 of the present invention.

The rotating blade 80 includes a flat circular disk 86 with a plurality of raised tooth edges 88 perpendicular to the flat disk 86. The raised tooth edges are generally perpendicular to the flat disk 86.

The rotating blade 80 includes a central opening 90 for attachment to the hub or to the blade motor shaft 72. The raised tooth edges or teeth 88 may be slightly higher at the trailing edge than at the leading edge. A plurality of optional openings 92 may also be provided between the central opening 90 and the outer circumference of the disk 86. In addition, a further set of openings 94 may be in the form of louvers or tabs which encourage movement of materials.

By experimentation, it has been determined that new, surprising and otherwise unexpected results in decreased dissolution times may be obtained by creation and application of the new mixing blade described herein as follows. Materials used in the experiments were as follows.

1) Metal containers, 1-quart or 1-gallon, US Friction top style;

2) Styrene-Butadiene-Styrene ("SBS") linear structured tri-block rubber commercially available containing 30% by weight block styrene and commercially known as Kibiton® PB-5301 for Chi Mei Corporation, Taiwan;

3) Suitable heating mantle and controller;

4) Mixer/Stirrer capable of controlling rotational speed to +/−2-rpm;

5) Test Blades or commercial mixing element 3-inches diameter size; and

6) Asphalt/Bitumen, PG58-28 grade.

The experimental formulation, expressed to total 100.00% by weight, as follows.

97.00% Asphalt/Bitumen, PG58-28 commercial product from Flint Hills Resources, MN, USA; and 3.00% SBS Polymer/Rubber Kibiton® PB-5301.

Blade experimental test conditions were as follows.

1) Heat PG64-22 graded Asphalt/Bitumen in round friction top (US) metal 1-gallon can 2,716.0-grams (97.00% by weight) by suitable means to 180° C. to 183° C. and maintain temperature throughout testing.

2) Attach test blade (the mixing element) to rotational shaft and lower test blade to 4-centimeter depth as measured from top of liquid to top of test blade and secure by suitable means to mixer.

3) Set mixer speed for the 3-inch impeller to 600 rotations per minute, 600-rpm (471 feet-per-minute peripheral tip speed) and begin stirring asphalt.

NOTE: This creates a tip speed of 471-feet-per-minute, a factor of >10 less than known art teachings.

4) Mark time Zero ("0") and begin addition of 84.00-grams SBS rubber (3.00%) to asphalt being stirred at 600-rpm by mixer and test blade.

5) Check contents of container periodically for complete dissolution, that is to say melting, of SBS into the mixing asphalt.

6) When all SBS is melted, note time as "Time to Melt" in minutes and discontinue mixing.

Experiment No. 0

Known Art Blade

A commercially available of test size blade known as the HSXP model was purchased from Quick Blades, Inc. This mixing blade is characterized by tooth design incorporating a shouldered notch on the top/bottom edge of the tooth. The tooth is also about ½-inch in width with a tangent angle inward of about 22.5° from the circumference formed by the trailing edge of each tooth. These teeth are about ¼-inch in height. The pumping vanes were pitched so as to cause downward and outward movement of materials. By experimentation as described above, it was found to take 150-minutes for the SBS to melt into the asphalt/bitumen using this blade.

Experiment No. 1

New Art No. 1 Blade

A test blade of which incorporated some of the features of the present invention wherein the serrations were made shoulderless, that is to say have pointed ends and half the diameter of the known art serration. The blade contained 15 teeth in total split between 5 teeth of the same width, ½-inch, as described in Experiment No. 0—Known Art but with serrations made shoulderless as previously described herein and 10 teeth of one-half the width, that is to say ¼-inch wide, of the known art blade and also having shoulder less serrations. This is to say, all teeth of the new art blade of Experiment No. 1 were of the same pitch and angle out from the blade edge but of two different widths. Also note the pumping vanes of the new blade as shown in FIGS. 6, 7 and 8. By experimentation as descried above, it was surprisingly found to take about 105-minutes for the SBS to melt into the asphalt/bitumen using the new art blade.

Experiment No. 2

New Art No. 2 Blade

A test blade which incorporated some of the features of the present invention wherein the pumping vanes of new art blade were replaced with the non-limiting example of 48 round serrated holes. It is within the purview of the art taught herein that many other shapes and sizes of openings are anticipated. In this non-limiting example, these serrated holes were composed of two diameter sizes. One of the hole sizes was ¼-inch and the other size being ⅛-inch diameter, respectfully. There were 18 serrated holes of ¼-inch diameter in a pattern of 12 holes around the outer diameter of the blade with 6 holes toward the blade center with the hole centered between the outer hole on either side this hole toward the center. This pattern then forms an outward triangle pattern of the centers of each hole with respect to the center of the blade. There are then 30 serrated holes of ⅛-inch diameter inter-dispersed radially and along diameter lines from the blade center. All else remained the same as to blade size, tooth pattern and size as in new art blade. Under experimental conditions as previously described this new art No. 2 Blade melted SBS into the asphalt/bitumen in 65-minutes.

Experiment No. 2E

New Art No. 2 Blade Used to Make Emulsions

The same blade as used in Experiment No. 2 above was used to make an emulsion of asphalt and water. It is known in the art of asphalt or bitumen emulsification that it is more difficult, in terms of power requirements and emulsion stability, to make a water-in-oil (a "W/O" or "inverted") than an oil-in-water (a "O/W" or "regular") emulsion. In this experiment, the New Art No. 2 Blade was used, in the non-limiting example to successfully make the more difficult to form water-in-oil or inverted emulsion.

Emulsion Formulation by Weight Percent 1.00% Thermogel, a Sepiolite clay from IMV Nevada, known to make water-in-oil emulsions;

45.00% Water, potable tap water at about 110° F. to 120° F.; and 54.00% 120/150 pen emulsion base asphalt at about 310° F. to 320° F.

Procedure

1—in 1-quart metal round friction top can add water;

2—Using mixer with speed control and rpm readout, insert New Art No. 2 Blade/shaft assembly;

3—Start mixing at about 200-rpm;

4—Add Thermogel and mix until thoroughly wetted and dispersed;

5—Slowly add by pouring preheated pre weighed asphalt into the water/Thermogel mixture;

6—Gradually increase mixer speed as more asphalt is poured into quart can until all asphalt is added;

7—Continue stirring contents for about 60-seconds; and

8—Discontinue mixing and examine for emulsion formation and stability.

The inverted water-in-oil emulsion was formed at a maximum of 900-rpm wherein the same emulsion with known art blades took more than 3000-rpm to form said emulsion. This is a surprising result in that greatly reduced power requirements, as measured by rotations per minute, were required when the new art blade was used to make an emulsion.

When the above procedure was employed, New Art No. 2 Blade formed the inverted W/O emulsion that was stable (each day examined with no asphalt/water separation and emulsion did not break upon vigorous hand stirring with stainless steel rod) in closed container under heated storage of about 140° F. for more than 3 days.

It is now taught by the non-limiting example above that various emulsions and types of emulsions can be formed by the present invention. Non-limiting examples of emulsion types would be anionic, cationic or non-ionic emulsions of various combinations of oils, liquids and or water with appropriate emulsifiers.

Experiment No. 3

New Art No. 3 Blade

A test blade which incorporated some of the features of the present invention wherein the teeth of new art blade are alternately pitched against each other in an alternating fashion on either side of the blade. Also altering the pumping vanes from new art No. 1 Blade to having serrations about the openings and tabs. Both the openings and tabs are twice the size of those in new art No. 1 Blade and most significantly, reversed in their projection of the materials being mixed. To make more clear, this is to say that the pumping vanes of new art No. 1 Blade project materials outward and downward while in FIG. 6 reference numbers 94*a* and 94*b* new art blade projects materials downward and inward at reference number 95*a* and 95*b* of FIG. 6. These features are illustrated in FIGS. 6, 7 and 8. Surprisingly, during experimentation, new art No. 3 Blade created excessive splashing wherein this was absent in the previously described new art and known art blades. Therefore, in order to reduce splashing, the rotational speed was reduced from 600-rpm to 400-rpm. Unexpectedly, the time to melt the SBS into the asphalt was the same, 150-minutes, as in Experiment 0,—Known Art Blade. This surprising result illustrates the ability of new art No. 3 Blade to be as efficient as Know Art Blade but with lower rotations per minute. It is now obvious to one of average skill in the art that the new art described herein is more efficient than previously known art due to its lower rotation per minute requirement.

Jet Stators—Jet mixers are devices composed of a fixed position immovable smooth walled tube (a type of stator) open at the top and bottom that surrounds an impeller. This apparatus was then attached to a vessel wherein mixing is to take place. The jet mixer relies on the ability of the impeller to either pull or push liquid through the smooth walled tube thereby creating the jet mixing action. The impeller or propeller blade(s) is (are) generally shaped so as to scoop or pump, by means of attachment to a rotating high speed fixed length shaft, reasonably close to the interior side of its surrounding stator. The objective of the stator and jet mixer in general, is to provide un-impinged acceleration to the liquid being mixed thereby improving turnover rate of the vessel contents which result in more efficient mixing. In order to limit impingement of the jet mixer stator, the stator generally has as smooth a wall as practical. Further, the impeller or propeller is typically designed to capture as much of the materials being mixed as possible by increasing the surface area of the elements on each impeller. The impeller/propeller is typically fixed in placed at one end or the other of the stator.

Rotor and stator mill combinations are common in mixing applications. The utilities of rotors with their corresponding stators to improve intimate mixing of materials are well understood. The stator itself may have either smooth or not smooth, that is to say textured, wall or surface; especially wherein the stator is of a flat (sometimes called "plate") or conical (a "cone") configuration. The rotating impeller, commonly called the rotor, is generally of various shapes, sizes and configurations that mate with the stator and rotate at very high speeds under very tight tolerances between itself and the stator, typically being measured in microns. It is common for these mechanical devices to be called Rotor/Stator or Colloid mills or Inline Dispersers.

Typical examples of both the Jet Stator and the Rotor/Stator mills known art are illustrated in the document "Mixing and Processing Technology" prepared by IKA® Works, Inc., of Wilmington, N.C. and included herein by reference. By reference therein, typical of Jet Stators and Rotor/Stator or Colloid mills or Inline Dispersers the impeller and or shaft of the rotor will rotate at about 1,200 or 4,000 or more rotations per minute (rpm or rpm's), respectively.

As a result of the above, current art requires the tip speed of the rotor to be quite high, generally in excess of several thousand feet per minute. To meet the requirement of necessary rotor tip speed, more power through the motor and shaft attachment is a resulting demand.

Stator design as related to jet mixing has always been that of a smooth wall. The examples below illustrate a non-limiting surprising benefit when the interior wall of the jet mixer is either dimpled or perforated. Both the dimpled and perforated walls have a plurality of two sizes. These sizes are ¼-inch and ⅛-inch in diameter.

It would be desirable to have a mixing device that would decrease the time required for mixing materials together and yet keep power requirements low.

Unexpectedly, such a mixing assembly has been created by unique combinations of rotor and stator configurations not previously understood by application of either Jet Stator or Rotor and Stator prior art. Such surprising findings are set forth by experimentation below in non-limiting preferred embodiments below.

Materials used in experiments as follows.

1) Metal containers, Round 5-gallon, US Open top;

2) Styrene-Butadiene-Styrene ("SBS") linear structured tri-block rubber commercially available containing 30% by weight block styrene and commercially known as Kibiton® PB-5301 for Chi Mei Corporation, Taiwan;

3) Suitable heating mantle and controller;

4) Mixer/Stirrer capable of controlling rotational speed to +/−2-rpm;

5) Known Art Test Blade=3-inches diameter HSXP from Quick Blades, Inc., Huntington, Ind.; and 6) Asphalt/Bitumen, PG58-28 grade.

The experimental formulation, expressed to total 100.00% by weight, as follows.

97.00% Asphalt/Bitumen, PG58-28 commercial product from Flint Hills Resources, MN, USA; and 3.00% SBS Polymer/Rubber Kibiton® PB-5301.

Stator experimental test conditions are as follows.

1) Heat PG64-22 graded Asphalt/Bitumen in round friction top (US) metal 1-gallon can 2,716.0-grams (97.00% by weight) by suitable means to 180° C. to 183° C. and maintain temperature throughout testing.

2) Stator is 5-inch diameter by 5-inch height (long) at 4-centimeter depth as measured from the top of the liquid to the top of the stator unless otherwise noted.

3) Unless otherwise noted, the test blade was a 3-inch diameter HSXP model from QuickBlades, Inc., IN, attached to a rotational shaft and lowed to 6-centimeter depth as measured from top of liquid to top of blade and secure by suitable means to mixer head/motor assembly.

NOTE: The blade at approximately the center by both diameter and height of the stator, not at the outward end as is known art, thereby leaving a 1-inch gap between the blade tip and stator wall.

4) Add 284.0-grams SBS (3.00% SBS by weight) to the container.

5) Set mixer speed for the 3-inch HSXP (or other as noted) to 600 rotations per minute unless otherwise noted and begin stirring asphalt. By calculation, 600-rpm is a 471 feet-per-minute peripheral tip speed.

NOTE: This creates a tip speed of 471-feet-per-minute, a factor of >10 less than known art teachings.

6) Mark time Zero ("0") and begin addition of 84.00-grams SBS rubber (3.00%) to asphalt being stirred at 600-rpm by mixer and test blade.

7) Check contents of container periodically for complete dissolution, that is to say melting, of SBS into the mixing asphalt.

8) When all SBS is melted, note time as "Time to Melt" in minutes and discontinue mixing.

While it is known in the art that Cowles or Hockmeyer blades can be used in a closed pipe or tube system, such blades have not previously been shown to have utility in combination with a jet mixer. In general, the Cowles blade relies on high rpm or tip speeds (>5,000 feet-per-minute) to adequately perform. This need for high rpm and tip speed limits their application in terms of tank size. For high speed blades used for dispersion purposed, an explanation of the "Dispersion Rules of Thumb" may be found in literature from DisperseTech, LLC (E.W. Kaufmann Co. at ewkaufmann.com) or through E.W. Kaufmann Company and now included herein by reference. Following the general rule of the blade diameter should be one-third (⅓) the tank diameter would mean that a 21-foot tank would need an exceedingly large 7-foot diameter Cowles blade to perform adequate mixing. Commercially available Cowles blades are typically no more than about 36-inches in diameter which would require 425 to 637 rpm (4000 to 6000 ft/min tip speed) which would or could only mix a tank of about 9-ft diameter by 6-ft in height. Therefore, for one of average skill in the art, the use of high speed dispersion blades would be impractical. Prior to the enclosed art, Cowles blades have not been shown to have utility while combined with a jet mixer. The non-limiting examples below comprise to teach new art applications of Cowles type blades in combination with jet mixing to decrease melt times thereby improving process efficiency. Further, such present invention is now shown to be adjustable to the fluid level in the tank wherein mixing is occurring.

Experiment No. 4

New Art by Known Art Blade without Stator

Using the known art HSXP high shear blade and no stator in container and under conditions described above the time to melt the SBS into the asphalt was found to be 255-minutes.

Experiment No. 5

New Art Application of Known Art Blade with Smooth Wall Jet Stator

In this experiment the smooth wall jet stator, shown in the drawings, was placed in the container as described above and under conditions described above. This Experiment No. 5 differs from Experiment No. 4 by the addition of the smooth wall stator. The time to melt the SBS into the asphalt was found to be 165-minutes. This is quite unexpected and surprising in respect to the low rpm requirements and a blade not typically designed for jet mixing applications. The results are also surprising in that there was excessive splashing of the contents of the container. Such splashing is known to be detrimental to the final product due to the excessive aeration of the asphalt as the SBS melted. Excessive aeration is known to oxidize asphalt that in turn makes the product more brittle in colder conditions. It is, in general desirable to avoid aeration of asphalt.

Experiment No. 6

New Art by Known Art Blade with Dimples in Wall of Jet Stator

Under above described conditions the stator had two sizes of dimples. Those dimple sizes were ¼-inch and ⅛-inch in diameter and at a depth of no more than ⅛-inch, on ¾-inch centers respectfully, having about a 1/32-inch shoulder as shown in FIGS. 6, 7 and 8. The surprising results of the experiment yield the time to melt the SBS into the asphalt at 150-minutes. This is an unexpected decrease in time over the smooth wall jet stator of Experiment 5 above.

Experiment No. 7

New Art by Known Art Blade with Holes in Wall of Jet Stator

In this experiment, the stator had two sizes of holes. The sizes for the holes were ¼-inch and ⅛-inch in diameter. The blade, as described above, and stator described herein were raised to 4-inches and 2-inches, respectfully in order to facilitate liquid/solids surface movement and mixing of the container contents. Under the conditions as noted herein the melt time of the SBS into the asphalt was found to be 150-minutes. The unexpected results of raising the blade and stator in unison yields the same SBS melt time as in Experiment No. 6 thereby illustrating the utility of need for the artisan to raise and or lower the unit or its component parts, blade or stator, to advantageously effect process results. Therefore a mechanism for moving the blade and or stator would be a desirable advancement of the art. In comparing this Experiment No. 7 to Experiment No. 5 the difference is a stator with holes verses a stator that is smooth walled, respectfully. With respect to these differences, the stator having a plurality of holes did not splash or aerate the asphalt as the SBS was melting into the mixture. This feature of not splashing would offer the potential for a better quality final product, especially with respect to being not as brittle under colder conditions verses a similar product as made under conditions as set forth in Experiment No. 6.

From the above examples it is now taught herein that other types of modifications to the jet mixer may prove advantageous to specific applications. Non-limiting examples of such modifications to the jet mixer stator wall could be grooves of various size, width, depth or shape. Said grooves may be somewhat square, rectangular, "U" or "V" shaped. Said grooves might also be essentially shoulder less or otherwise have no space between each individual groove thereby forming serrations or edges; non limiting pattern of "W" for example. Said grooves, that might also be called channels, may extend up and down, across at an angle or otherwise be shaped to aid in a given mixing application. The unexpected results of raising the blade and stator in unison yields the same SBS melt time and decrease unwanted splashing of container contents as in Experiment No. 7 verses Experiment No. 8, above, thereby illustrating the utility of need for the artisan to raise and or lower or otherwise adjust the unit or its component parts, blade or stator, to advantageously effect process results. Therefore a mechanism for moving the blade and or stator would be a desirable advancement of the art. In comparing this Experiment No. 7 to Experiment No. 5 the difference is a stator with holes verses a stator that is smooth walled, respectfully. With respect to these differences, the stator having a plurality of holes did not splash or aerate the asphalt as the SBS was melting into the mixture. This feature of not splashing would offer the potential for a better quality final product, especially in with respect to being not as brittle under colder conditions verses a similar product as made under conditions as set forth in Experiment No. 6.

Figure 9:
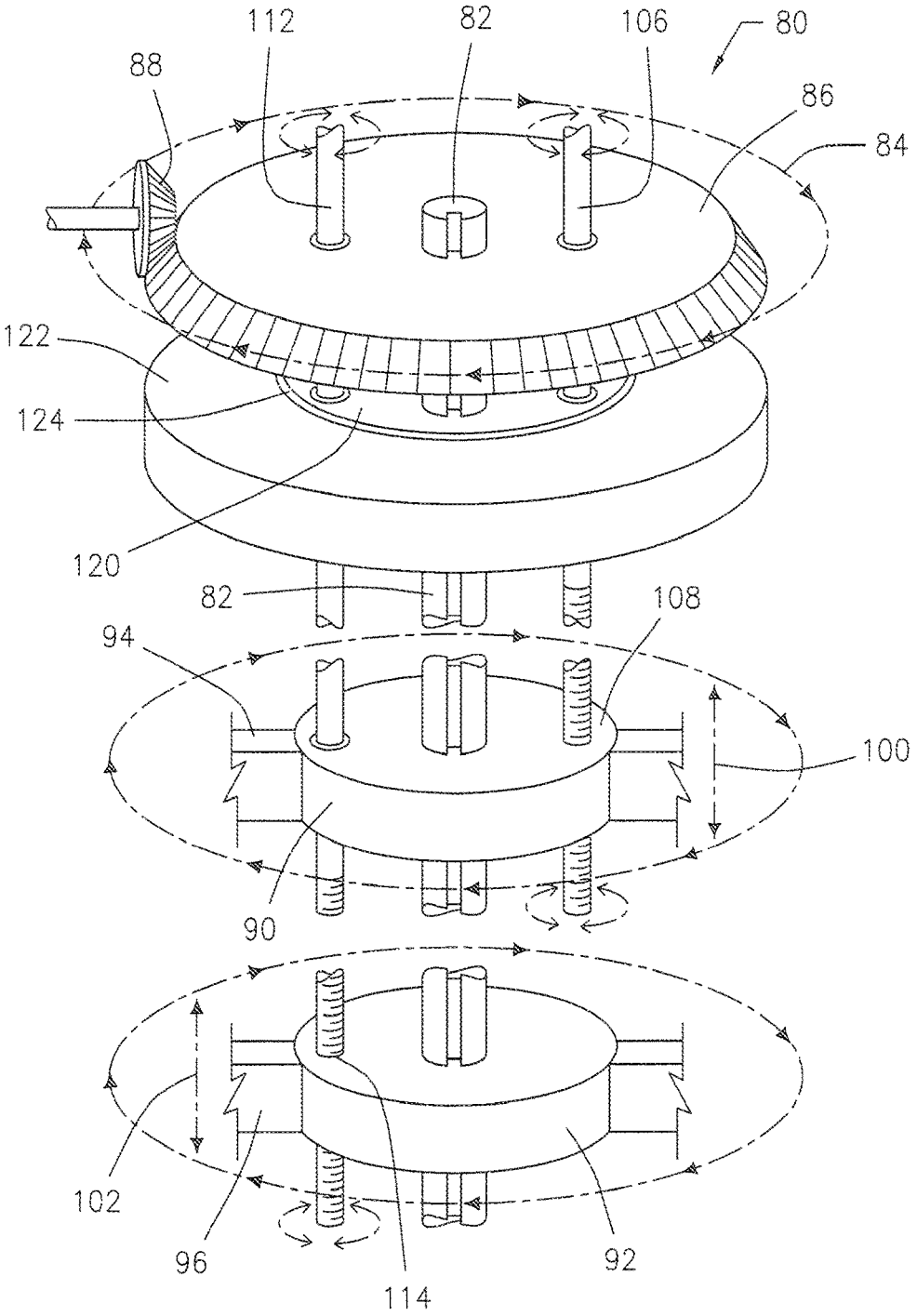
FIG. 9 illustrates an alternate embodiment of a vertically moving horizontal mixer assembly in accordance with the present invention.

As an alternate embodiment, FIG. 9 illustrates a mechanism to mix and disperse solids in a liquid. The assembly 80 includes a center shaft 82 which will be rotated in a direction shown by arrows 84. The shaft 82 may be non-circular. In the embodiment shown in FIG. 9, the shaft includes a recess which receives a key on a drive plate 86. The disk 86 is driven by a right hand gear 88 which, would in turn, be connected to a motor (not shown). Accordingly, rotation of the drive gear 88 would rotate the disk 86 which, in turn, would rotate the shaft 82. A pair of hubs 90 and 92 surround the shaft but are not rigidly attached thereto. A plurality of blades 94 and 96, respectively, extend from each of the hubs (partially cut away in FIG. 9). Each hub 90 and 92 also has an extending key that mates with the slot in the shaft 82. Accordingly, rotation of the shaft rotates the hub and, in turn, each of the blades.

A mechanism is provided to move each of the hub and blade assemblies vertically or axially in the direction shown by arrows 100 and 102.

The mechanism is provided to move the hub 90 and its blades 94 and move the hub 92 and its blades 96 vertically in the direction shown by arrows 100 and 102. A threaded screw drive 106 extends parallel to and spaced from the axis of the shaft 82. The threaded screw drive 106 engages hub 90 at a threaded opening 108. As the screw drive 106 is rotated in one direction, the engagement with the threaded opening 108 causes the hub 90 and propellers 94 to move axially or vertically in a first direction while rotation of the screw drive in a second direction will cause the hub and propellers to move axially or vertically in the opposite direction. Likewise, threaded screw drive 112 extends parallel to and spaced from the axis of the shaft 82. The threaded screw drive 112 engages the hub 92 at a threaded opening 114 therethrough. The screw drive 112 may be rotated in the direction shown by arrows 116 and 118. Accordingly, as the screw drive 112 is rotated in a first direction, the engagement with the threaded opening 114 will cause the hub and the propellers to move axially or vertically in a first direction while rotation of the screw drive 112 in a second direction will cause the hub and propellers to move axially or vertically in the opposite direction.

The hub and propeller assembly 80 may also include a rotating disk 120 which rotates with rotation of the shaft. The disk 120 is engaged with stationary disk 122 with a bushing 124 therebetween. The stationary disk 122 may be attached to the top of a tank (not shown), making the assembly easy and simple to retrofit to an existing tank.

Figure 10:
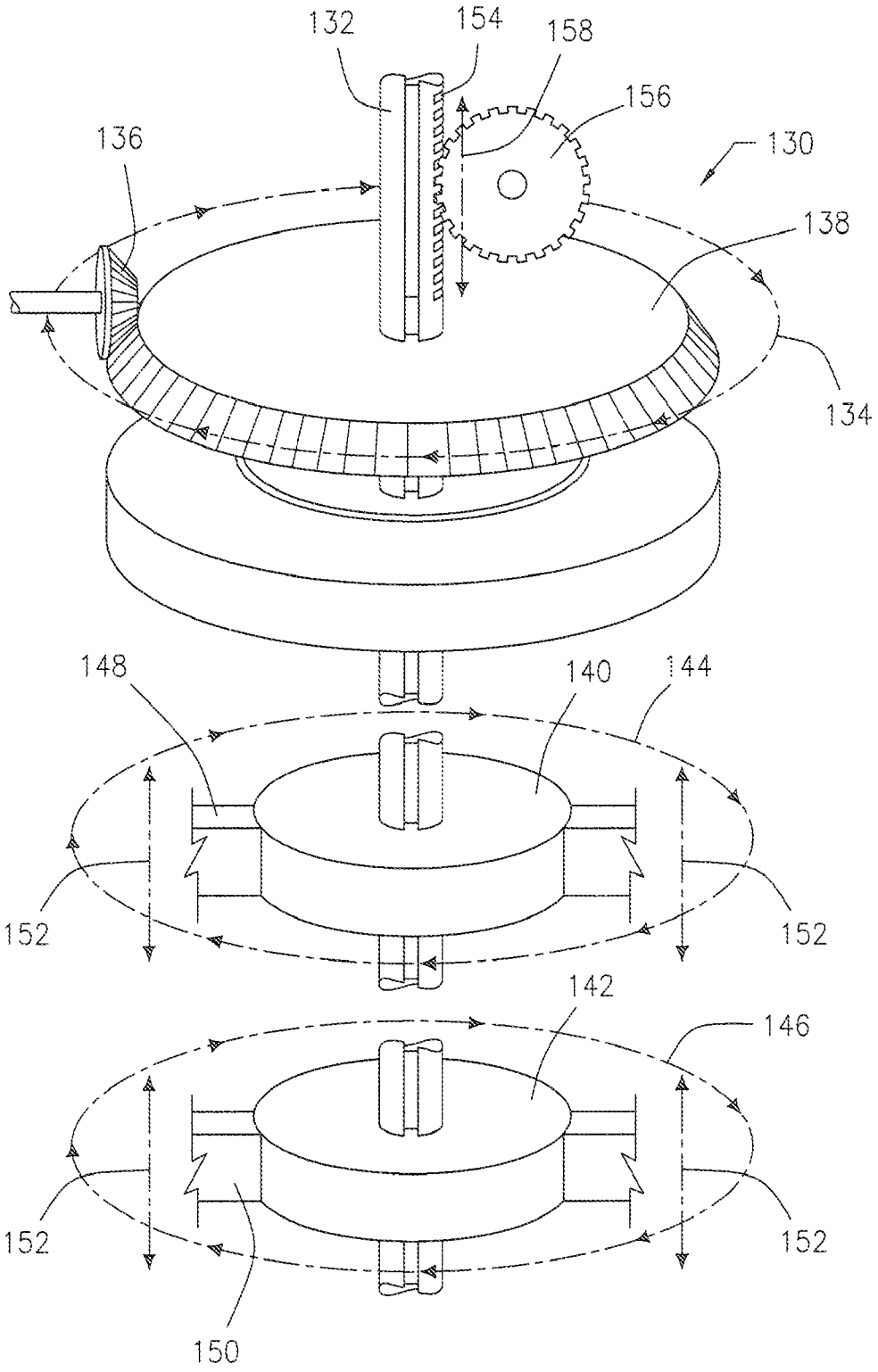
FIG. 10 illustrates a further alternate embodiment of a vertically moving horizontal mixer assembly in accordance with the present invention.

FIG. 10 illustrates a perspective view of a further, preferred embodiment. The assembly 130 includes a shaft 132 which is rotatable in the direction shown by arrows 134. The shaft is rotated by means of a right hand gear 136 connected to a motor (not shown). The right hand gear 136 engages a drive hub 138 having external angled gears to match the gears on the right hand gear 136. Accordingly, rotation of the right hand gear 136 rotates the hub 138 which, in turn, rotates the shaft. The hub and prop assembly 130 may include a first hub 140 and a second hub 142 spaced therefrom. The first hub is rotatable in the direction shown by arrows 144 while the second hub is rotatable in the direction shown by arrows 146. Each of the hubs 140 and 142 surrounds the shaft 132 but is not rigidly attached thereto. Extending from hub 140 is a set of blades 148 while extending from hub 142 is a set of blades 150.

A mechanism is provided to move the hubs and the blades vertically or axially in the direction shown by arrows 152. A portion of the shaft 132 includes a set of teeth 154. A drive gear 156 may be brought into engagement with the teeth 154. Rotation of the drive gear 156 will cause axial or vertical movement of the shaft 132 in the direction or directions shown by arrow 158. Accordingly, axial or vertical movement of the shaft 132 results in corresponding movement of the hubs 140 and 142 and the blades 148 and 150, respectively.

In addition to the foregoing, the teachings of the present invention may be combined with the teachings of Applicant's U.S. Pat. No. 5,938,326 entitled "Combination Dispersion And Skimming Device."

Whereas, the present invention has been described in relation to the drawings attached hereto, it should be understood that other and further modifications, apart from those shown or suggested herein, may be made within the spirit and scope of this invention.

What is claimed is:

1. A horizontal mixer assembly, which comprises:

a tank having an axis;

a hub parallel to said tank axis; and a rotating blade perpendicular to said tank axis, said blade being a flat circular disk with raised tooth edges perpendicular to said disk around a circumference of said blade, wherein said raised tooth edges have shoulderless serrations and wherein said raised tooth edges are slightly higher at a trailing edge than at a leading edge and including a plurality of serrated edge openings through said flat circular disk between said circumference and the center of said disk.

2. The horizontal mixer assembly as set forth in claim 1 wherein said plurality of serrated edge openings are of more than one size.

3. The horizontal mixer assembly as set forth in claim 2 wherein said plurality of serrated edge openings of more than one size are circular.

4. The horizontal mixer assembly as set forth in claim 2 wherein said plurality of serrated edge openings of more than one size are trapezoidal.

5. The horizontal mixer assembly as set forth in claim 4 wherein said trapezoidal openings include louvers or tabs extending from the flat circular disk.

6. The horizontal mixer assembly as set forth in claim 1 wherein said raised tooth edges are not tangential to said circumference of said disk but are angled therefrom.

7. The horizontal mixer assembly as set forth in claim 1 wherein said raised tooth edges extend perpendicular to said disk in either direction.

* * * * *